US006137444A

United States Patent [19]

Pettersson et al.

[11] Patent Number: 6,137,444

[45] Date of Patent: Oct. 24, 2000

[54] METHOD OF PRODUCING AN ANTENNA ELEMENT ASSEMBLY

[75] Inventors: John Pettersson, Stockholm; Stefan Jonsson, Stocksund, both of Sweden

[73] Assignee: Allgon AB, Åkersberga, Sweden

[21] Appl. No.: 09/161,391

[22] Filed: Sep. 28, 1998

[30] Foreign Application Priority Data

Oct. 1, 1997 [SE] Sweden ..... 9703586

[51] Int. Cl.[7] ..... H01Q 1/38

[52] U.S. Cl. ..... 343/700 MS; 343/851

[58] Field of Search ..... 343/700 MS, 795, 343/833, 834, 835, 836, 837, 839, 702

[56] References Cited

U.S. PATENT DOCUMENTS

| | | | |
|---|---|---|---|
| 4,546,357 | 10/1985 | Laughon et al. | 343/702 |
| 4,812,855 | 3/1989 | Coe et al. | 343/700 MS |
| 5,008,681 | 4/1991 | Cavallaro et al. | 343/700 M |
| 5,355,143 | 10/1994 | Zurcher et al. | 343/700 M |
| 5,448,250 | 9/1995 | Day | 343/700 MS |
| 5,510,802 | 4/1996 | Tsuru et al. | 343/700 MS |
| 5,566,441 | 10/1996 | Marsh et al. | 29/600 |
| 5,717,407 | 2/1998 | Hong | 343/700 MS |

FOREIGN PATENT DOCUMENTS

97/14157 4/1997 WIPO .

*Primary Examiner*—Hoanganh Le
*Assistant Examiner*—James Clinger
*Attorney, Agent, or Firm*—Jacobson, Price, Holman & Stern, PLLC

[57] ABSTRACT

A method of producing an antenna element assembly is disclosed. The antenna element assembly (4) includes a rigid dielectric support member (1) carrying at least one radiating patch (2), the antenna element assembly being intended to be mounted onto an antenna device for transmitting and/or receiving microwave radiation. According to the invention, parasitic elements (3*a*, 3*b*) as well as the radiating patches (2) are formed onto the rigid support member by applying a conductive liquid in a screen printing process.

15 Claims, 3 Drawing Sheets

METHOD OF PRODUCING AN ANTENNA ELEMENT ASSEMBLY

BACKGROUND OF THE INVENTION

The present invention relates to a method of producing an antenna device for transmitting and/or receiving dual polarized electromagnetic radiation, in particular in the microwave region, in two orthogonal channels, said antenna device including a rigid, dielectric support member carrying a row of radiating patches and parasitic elements being arranged on two opposite lateral sides of said row of radiating patches so as to maintain a high degree of isolation between said two orthogonal channels. The invention also relates to an antenna device, produced by the method.

In recent years, new methods have been developed to form thin metallic layers to be used as antenna elements or other electrical circuit components, in particular by applying a conductive liquid, sometimes referred to as a conductive paint or ink, onto a substrate or support member. Compare e.g. the U.S. patent specification 5566441 (British Technology Group Ltd.) or the published PCT document WO 97/14157 (IMG Group Ltd.).

Normally, such antennas or other circuit components are directly connected to electrical terminals for conductively feeding electrical energy to the antenna element or the corresponding component.

SUMMARY OF THE INVENTION

In contrast, the present invention concerns a method of producing an antenna device with a row of radiating patches, without conductive feed terminals, but cooperating with a feed network having a row of feed elements located at a distance from but in registry with the radiating patches, a general object being to control in an optimal way the performance and radiating characteristics of the radiating patches.

A more specific object is to provide a production method and an antenna device being capable of transferring dual polarized electromagnetic waves while maintaining a high degree of isolation between the dual polarized electromagnetic waves, which constitute the two orthogonal channels.

According to the invention, these objects are achieved by applying a conductive liquid onto the rigid support member so as to form, upon being solidified, said radiating patches as well as said parasitic elements in a predetermined geometrical pattern. Preferably, the patches and the parasitic elements are formed on the same side of the rigid support member. By using conventional screen printing processes, e.g. a silk screen process, the geometrical pattern can be made very exact in a relatively simple manner, whereby extremely good radiation characteristics, in particular a high degree of isolation between the two orthogonal channels, can be obtained.

Advantageously, the patches and the parasitic elements are formed in a planar geometrical pattern, whereby the screen printing process is facilitated. In case the support member and the geometrical pattern should have a three-dimensional shape, such a shape is preferably obtained by bending the support member in a controlled way upon forming the geometrical pattern in a planar configuration. In a preferred embodiment, the support member is bent along two mutually parallel bending lines so as to form a central planar portion carrying the patches and two lateral side portions standing at an angle from the central planar portion, each of the lateral side portions carrying parasitic elements or portions thereof. If the parasitic elements extend across a bending line, the geo-metrical pattern is preferably formed on the inside of the bent support member. In this way, undue stretching of the thin parasitic elements can be avoided.

BRIEF DESCRIPTION OF THE DRAWINGS

The invention will now be explained below with reference to the appended drawings illustrating a preferred embodiment of the invention.

DETAILED DESCRIPTION OF THE PREFERRED EMBODIMENTS

Figure 1:
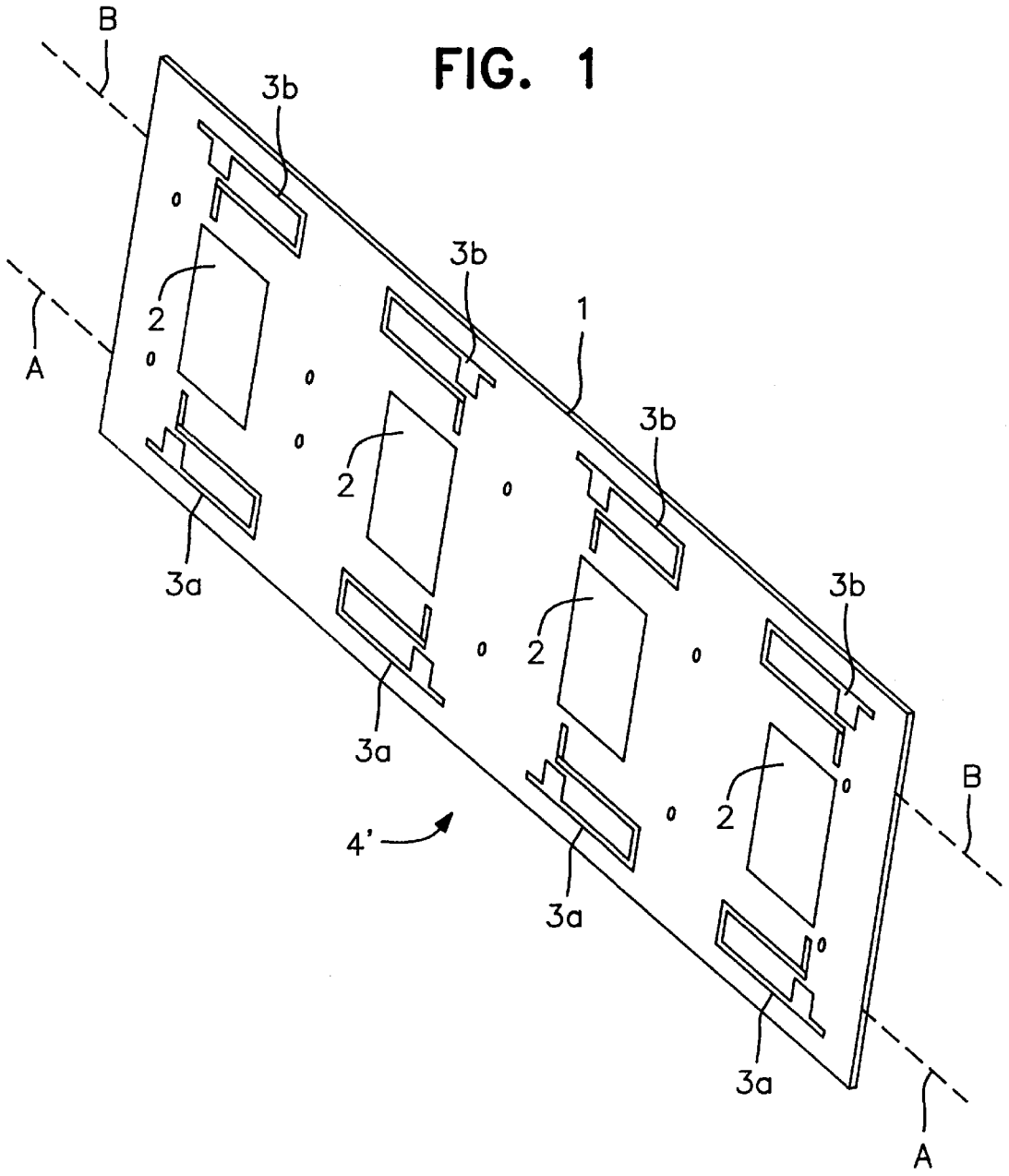
FIG. 1 shows a rectangular, planar support member with a geometrical pattern printed thereon.

In FIG. 1, there is shown a rectangular, rigid support member 1 made of dielectric material, e.g. a plastic sheet of a shape-permanent plastic material, such as polycarbonate, or a composite substrate, such as epoxi-fibre glass or the like. In any case, the material of the support member should be relatively rigid and non-deformable when being used in an antenna device for outdoor use.

According to the invention, radiating patches 2 and parasitic elements 3*a*, 3*b* are formed onto the support member 1 by applying a conductive liquid onto the support member 1, preferably by a screen printing process. Upon being solidified, the patches 2 and the parasitic elements 3*a*, 3*b* will form electrically conductive elements constituted by a thin layer and forming a predetermined geometrical pattern. Nowadays, such conductive liquids, also denoted a conductive paint or a conductive ink, are commercially available from various suppliers, e.g. a conductive, silver based coating sold by SPRAYLAT, Mount Vernon, N.Y., USA, the material being designated as series 599-B 3564. The conductive liquid is preferably applied by a well-known screen printing process, but other printing processes may be used as well. The important feature is to secure well-defined edges of the metallic elements with tolerances in the order of 0.1 mm or less.

Figure 2:
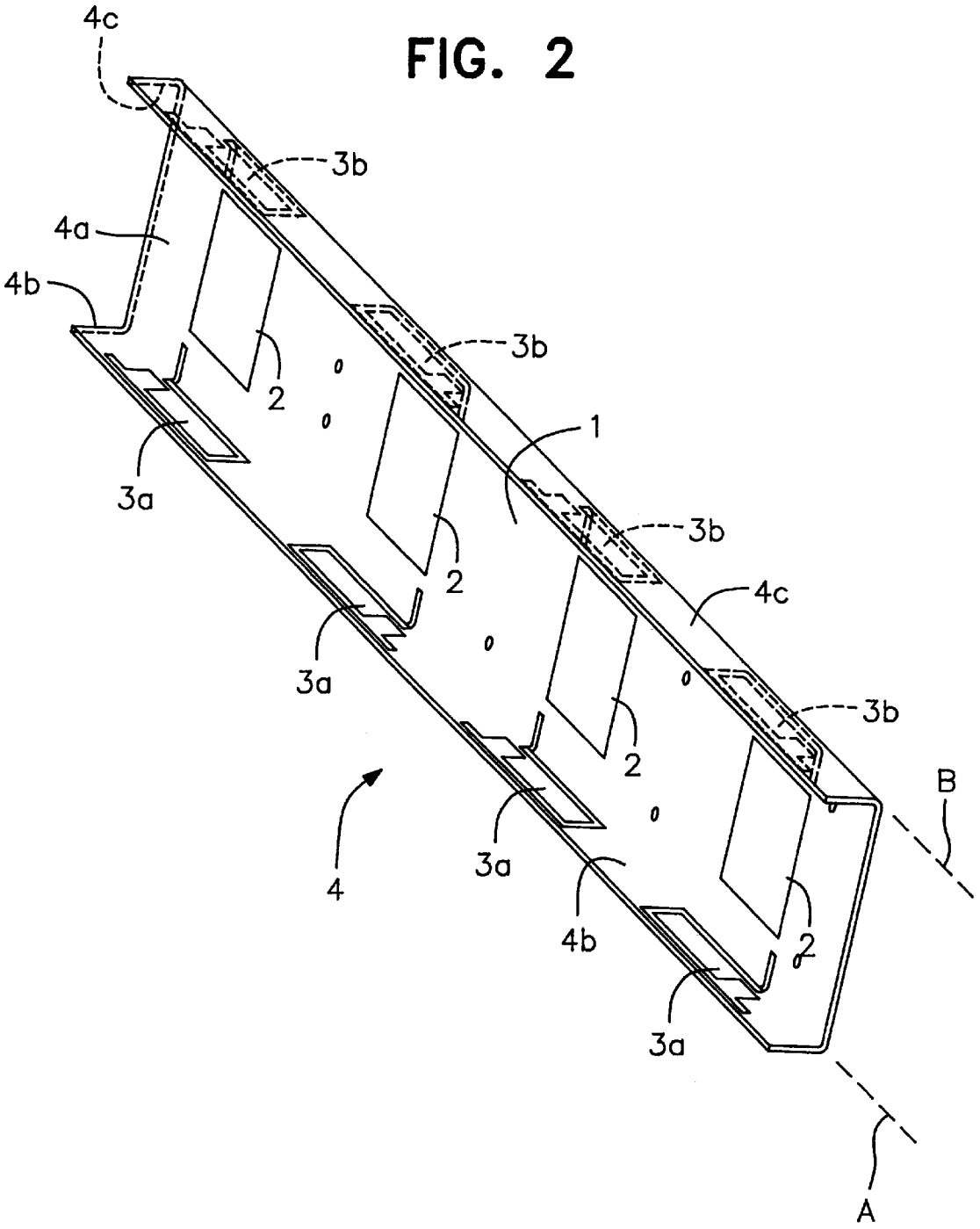
FIG. 2 shows the support member of FIG. 1 in a perspective view upon being bent along the side portions thereof.

In this way, it is possible to obtain the required characteristics of the patches 2 which cooperate with the adjoining parasitic elements 3*a*, 3*b* during use of an antenna device including an antenna element assembly 4' (FIG. 1) or 4 (FIG. 2). By the well-defined edges of the printed metallic elements, the problems of intermodulation products of the signals are substantially eliminated.

The use of parasitic elements in the vicinity of antenna patches has been suggested previously in Swedish patent application 9700401-4 (U.S. Ser. No. 09/018,851) and Swedish patent application 9702786-5 (U.S. Ser. No. 09/120,885). in particular with parasitic elements surrounding each patch at least on two opposite lateral sides thereof and also including the space between and including two parallel planes being defined by a ground plane layer and the antenna patches, respectively, each such parasitic element comprising at least one elongated, longitudinal portion extending along an associated one of the opposite lateral sides of the respective antenna patch. Accordingly, the present invention concerns primarily the method of applying such patches and parasitic elements rather than the particular configuration or structure as such.

Of course, when using a screen printing process, e.g. a silk-screen process, the process is easier to carry out if the substrate or support member is planar, as illustrated in FIG. 1.

In case the support member 1 and the finished antenna element assembly, including the patches 2 and the parasitic elements 3*a*, 3*b*, should have a three-dimensional shape, the support member 1 can preferably be deformed by bending in a separate step after completing the screen printing process.

Thus, in order to obtain a support member 4 as shown in FIG. 2, the support member 1 is bent, subsequent to the forming of the patches 2 and the parasitic elements 3*a*, 3*b*, along two mutually parallel bending lines A and B which are parallel also to the respective longitudinal edges of the rectangular sheet 1. Thus, the longitudinal edge portion including the parasitic elements 3*a* is bent upwards in FIG. 1 along the bending line A, and the opposite longitudinal edge portion containing the parasitic element 3*b* is likewise bent upwards along the bending line B. In this way, there is formed a central planar portion 4*a* carrying the centrally located patches 2, and two lateral side portions 4*b* and 4*c*, respectively, which extend, as seen in cross-section at an angle, normally approximately at a right angle from the central planar portion 4a, each of the lateral side portions 4*b*, 4*c* carrying the respective parasitic elements 3*a*, 3*b*.

Preferably, the bending is performed such that the two lateral side portions 4*b*, 4*c* are oriented in the same general direction as the direction towards which the geometrical pattern 2, 3*a* faces. In other words, upon bending, the geometrical pattern including the patches 2 and parasitic elements 3*a*, 3*b*, is located on the inside of the antenna element assembly.

Figure 3:
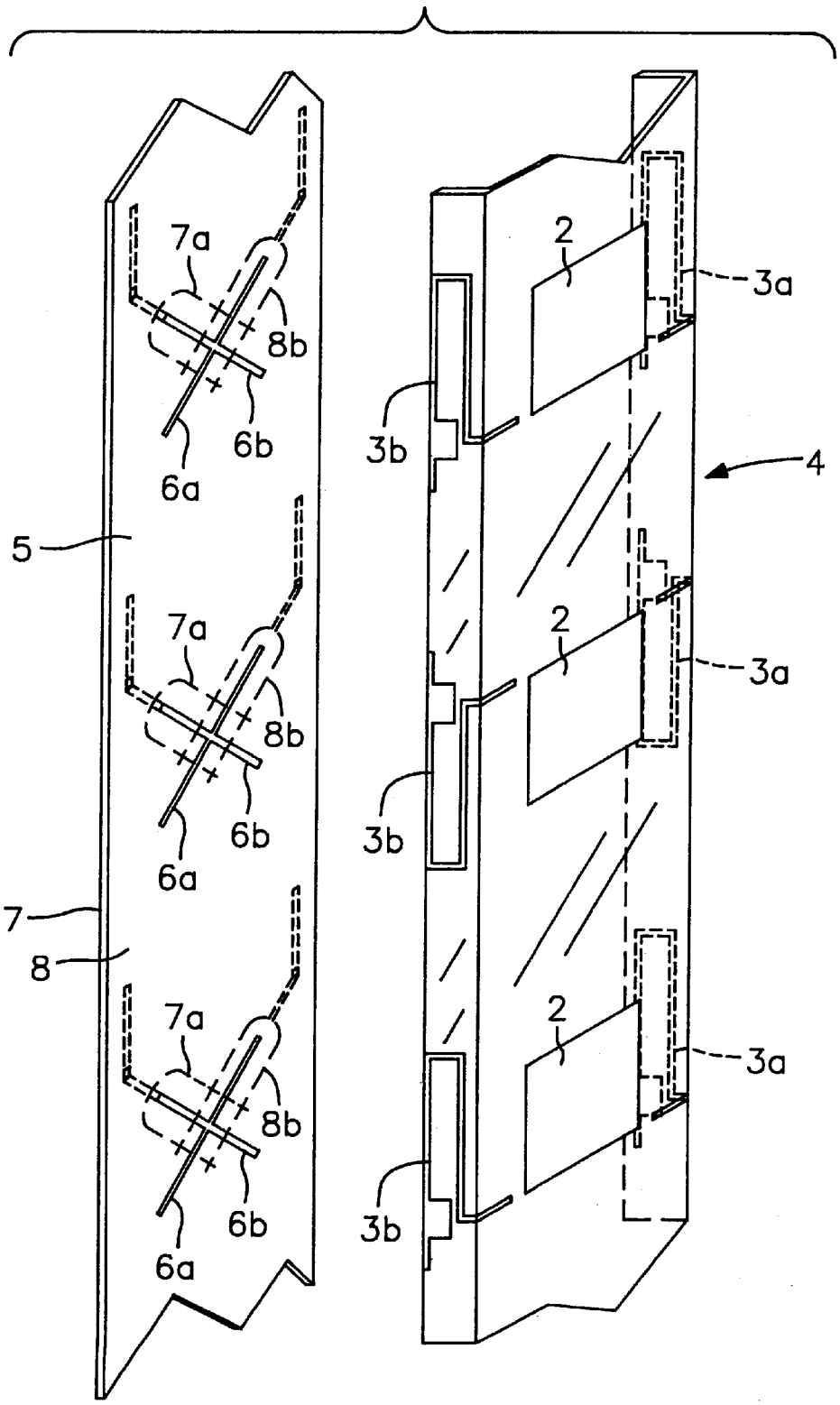
FIG. 3 illustrates the basic parts of an antenna device including an antenna element assembly as shown in FIG. 2.

In FIG. 3, there is shown the basic components of an antenna device including an antenna element assembly 4 as shown in FIG. 2. Of course, however, the antenna element assembly 4 has been turned around in FIG. 3, so that the patches 2, located on the inside of the antenna element assembly 4, are facing the structure shown to the left in FIG. 3.

The latter structure includes a ground plane layer 5 of an electrically conducting material and having a number of cross-shaped apertures 6*a*, 6*b* arranged in a longitudinal row in registry with the antenna patches 2. On each side of the ground plane layer 5 there is a dielectric layer 7 and 8, respectively, each provided with a feed network having feed elements 7*a* and 8*b* for feeding microwave energy from the respective feed network, via the aperture slots 6a and 6*b*, respectively, to the radiating patches 2, from which a microwave beam is transmitted in a well-defined lobe from the front side of the antenna (to the right in FIG. 3).

As is known per se, the feed elements 7*a* and 8*b* are fork-like and cooperate exclusively with a respective one of the two orthogonal apertures 6*a*, 6*b* so as to generate dual polarized microwaves being radiated from the patches 2. As is also known per se, the parasitic elements 3*a*, 3*b* will enhance the isolation between the two orthogonal channels.

The method, the antenna element assembly and the antenna device according to the invention may be modified by those skilled in the art. For example, it is possible to print the patches 2 and the parasitic elements 3*a*, 3*b* on opposite side of the support member 1. However, of course, it is preferable to apply these elements on the same side in a single step of the printing process.

The support member 1 may be planar. Alternatively the bent lateral side portions may stand obliquely from the central planar portion, and other three-dimensional shapes of the antenna device are also possible.

We claim:

1. The method of producing an antenna device for transmitting and/or receiving dual polarized electromagnetic radiation, in two orthogonal channels, said antenna device including a feed network with feed elements adapted to transfer electromagnetic energy in said two orthogonal channels, and a rigid, dielectric support member carrying a row of radiating patches electromagnetically coupled to said feed elements, and parasitic elements arranged on two opposite lateral sides of said row of radiating patches so as to maintain a high degree of isolation between said two orthogonal channels, said method including the step of applying a conductive liquid onto the support member so as to form, upon being solidified, said row of radiating patches as well as said parasitic elements in a predetermined geometrical pattern with well-defined contour lines.

2. The method as defined in claim 1, wherein said row of radiating patches and said parasitic elements are formed on the same side of said rigid support member.

3. The method as defined in claim 2, wherein said row of radiating patches and said parasitic elements are formed in a planar geometrical pattern onto said rigid support member.

4. The method as defined in claim 3, wherein, upon forming said planar geometrical pattern, said support member is bent along two mutually parallel bending lines so as to form a central planar portion carrying said row of radiating patches and two lateral side portions standing at an angle from said central planar portion, each of said lateral side portions carrying at least a portion of said parasitic elements.

5. The method as defined in claim 4, wherein a portion of said parasitic elements extends across each bending line said geometrical pattern being formed on the inside of said bent support member.

6. The method as defined in claim 1, wherein said conductive liquid is applied onto said rigid support member by a screen printing process.

7. An antenna device for transmitting and/or receiving dual polarized electromagnetic radiation, in two orthogonal channels, said antenna device including a feed network with feed elements adapted to transfer electromagnetic energy in said two orthogonal channels, and a rigid, dielectric support member carrying a row of radiating patches electromagnetically coupled to said feed elements, and parasitic elements arranged on two opposite lateral sides of said row of radiating patches so as to maintain a high degree of isolation between said two orthogonal channels, wherein said row of radiating patches as well as said parasitic elements are formed by a conductive liquid applied onto said support member and being solidified in a predetermined geometrical pattern with well-defined contour lines.

8. The antenna device as defined in claim 7, wherein said support member includes a central planar portion carrying said row of radiating patches and two lateral side portions, which extend, as seen in cross-section from said central portion, substantially at the same angle relative to said central planar portion and which carry at least a portion of said parasitic elements.

9. The antenna device as defined in claim 7, further comprising a ground plane layer (5) of electrically conducting material and a feed network (7, 8) having a row of feed elements (7*a*, 8*b*) located in registry with said row of radiating patches (2), each feed element including two feed element portions (7*a*, 8*b*) adapted to transfer electromagnetic energy in said two orthogonal channels.

10. The antenna device as defined in claim 13, wherein said lateral side portions carrying said parasitic elements, are located adjacent to opposite side edge portions of said ground plane layer.

11. The method as defined claim 4, wherein said angle is a right angle.

12. The antenna device as defined in claim 8, wherein said two lateral side portions extend substantially at a right angle from said central planar portion.

13. The antenna device as defined in claim 8, further comprising a ground plane layer, with cross-shaped apertures located in registry with said feed elements and said row of radiating patches.

14. The method of claim 1, wherein each feed element of the feed network operates with dual polarization.

15. The antenna device as defined in claim 7, wherein each feed element of the feed network operates with dual polarization.

* * * * *